United States Patent [19]

Fehrs

[11] 3,946,927

[45] Mar. 30, 1976

[54] MAGAZINE FOR FASTENER-DRIVING APPARATUS

[75] Inventor: Hellmuth Fehrs, Hamburg, Germany

[73] Assignee: Joh. Friedrich Behrens, Ahrensburg, Germany

[22] Filed: June 20, 1974

[21] Appl. No.: 481,170

[30] Foreign Application Priority Data

June 27, 1973 Germany ..... 2332533

[52] U.S. Cl. ..... 227/126; 227/127

[51] Int. Cl.[2] ..... B25C 5/06

[58] Field of Search ..... 227/125, 126, 127, 128

[56] References Cited

UNITED STATES PATENTS

| | | | |
|---|---|---|---|
| 1,996,640 | 4/1935 | Case | 227/126 |
| 2,755,473 | 7/1956 | Spencer | 227/127 |
| 2,817,839 | 12/1957 | Skrebba | 227/128 |
| 3,207,405 | 9/1965 | Langas et al. | 227/125 |

*Primary Examiner*—Granville Y. Custer, Jr.
*Attorney, Agent, or Firm*—Beaman & Beaman

[57] ABSTRACT

A magazine for fastener-driving apparatus includes a guide on which the fasteners are located, a slide movable along the guide under the action of a spring to feed the fasteners into a driving position and a cover which fits over the guide. The cover is displaceable in a direction transverse to the feed direction into a release position to permit the introduction of fasteners into the magazine.

10 Claims, 8 Drawing Figures

1
2
3
4
5
6
7
8
9
10
11
12
13
14
15
16
17
26

MAGAZINE FOR FASTENER-DRIVING APPARATUS

FIELD OF THE INVENTION

The invention relates to a magazine for apparatus for the driving-in of staples, nails or like fastener elements, said magazine including a guide which is capable of being fastened to the apparatus housing and by which fastener elements in the form of strips are received, and a slide, which cooperates with the guide and serves, in use, under the action of a feed spring, to feed the fastener elements along the guide to an ejection channel of the housing, the magazine also including a resiliently displaceable cover above the guide which is movable laterally into a release position to permit the introduction of fastener elements but which prevents, in its operative position, the fastener elements from falling out of the magazine.

DESCRIPTION OF THE PRIOR ART

A series of magazines which have a number of disadvantages, have become known, more especially for pneumatic nailing apparatus. There is known from U.S. Pat. No. 2,585,942 a magazine for a pneumatic nailing machine which works according to the socalled top loading principle. The top of the magazine is covered by a rail which is pulled back completely for the loading process in order to release a staple carrier on which the U-shaped staples are placed. Through the pulling-back of the covering rail the staple slide is also pulled back into its retracted position. In the case of such a magazine, insertion of the U-shaped staple bars takes place in a comparatively complicated manner and this impedes a fast working rhythm. This known magazine also proves to be disadvantageous when long-limbed staples are used, since there is then little free space between the magazine and the handle that is gripped by the hand of the operator. An accurate guide, which is moreover subject to considerable wear, is necessary for the covering rail. Finally, the long covering rail, which is pulled rearwardly through a considerable distance, disturbs the loading process.

There has also become known, for a stapling apparatus, a magazine working according to the so-called bottom loading principle, in the case of which the stapling apparatus is held on its head for the loading process. Through the pushing-back of a bottom plate, the interior of the magazine is exposed for the purpose of inserting staple strips. This magazine presents the hitherto best loading system, but it is unsuitable for large instruments, since it cannot be expected of anyone to turn over large pneumatic instruments which are comparatively heavy.

In addition, there is known a magazine for apparatus for the driving-in of fastener elements, in the case of which the staples are pushed from the rear on to a staple carrier. This magazine has the advantage that no long projecting movable parts are provided. As a result of the absence of movable parts very little wear occurs. However, it is disadvantageous that the strip of staples has to be mounted in a troublesome manner on the staple carrier in the interior of the magazine. The staple strips are then pushed forward as far as a stop spring, so that the resilient arms of the staple slide do not push the staples out again when they slide back along the staple limbs.

There have furthermore become known magazines which work according to the top loading principle and which can either be swung out laterally, about a vertical axis, into a loading position (German Auslegeschrift No. 1,188,009) or which can be swung into the loading position about an axis parallel to the handle (German Offenlegungschfrift No. 1,478,916). However, the expenditure required for this purpose is comparatively high. Particularly in the case of large apparatus with a high driving force, it is desirable that the guide channel for the fastener elements should not be connected to the magazine in a releasable manner but that it should be positively connected.

A magazine for a nailing device is also known which is pulled forwardly for loading, in order to provide access to the interior of the magazine from above. Access is particularly good here, but since the entire, normally fairly heavy magazine has to be moved, effective guide tracks, which are of necessity subject to wear, are required. Moreover, such a magazine renders necessary an additional safety device for the loading position.

There is another known stapling magazine in which the guide rail receiving the staples is arranged relatively freely. Merely a spring rail presses downwardly on to the crosspieces of the staples or on to the back of the staple slide. For loading, the staple slide is locked, against the spring force of the feed spring, in a rearward position and the spring rail is bent sidewards. However, this process is time-consuming, because the staple strips are pushed on to the staple carrier against the spring force of the spring rail.

Finally, a stapling magazine for a stitching instrument has become known in which a steel band is arranged above the guide rail which receives the staples, which steel band penetrates the staple slide. The steel band entirely or partially releases the magazine region behind the staple slide. However, a partial covering is disadvantageous because access is difficult. A complete release is, however, only achieved with the aid of coil springs which do not ensure an adequate guidance and covering of the staples. Moreover, the expenditure for a cover is comparatively high, in the event of coil springs being used.

It is therefore an object of the invention to provide a magazine for an instrument for the driving-in of fastener elements which can be operated in a simple manner, is low in expenditure and ensures easy access to the magazine.

SUMMARY OF THE INVENTION

In accordance with the invention, the cover is guided for displacement transversely to the feed direction of the slide against the action of a spring for movement from its operative position towards its release position.

In the magazine according to the invention, the cover fulfils two functions. On the one hand, it forms an effective cover for the guide and a reliable guide track for the fastener elements. On the other hand, the cover represents, in its release position, into which it is brought by lateral displacement thereof, a guide for the staples or other fastener elements during the loading process. By this means, it is not necessary that the fastener elements are introduced vertically from the top, since during insertion they are guided into their correct positions with the aid of the cover. A further advantage is the low expenditure for the magazine according to the invention. Moreover, the cover does not, in the position of release, form a disturbing projecting part which makes handling of the entire apparatus difficult. Finally, the cover completely releases, in its release position, the upper side of the magazine, so that the entire length of the magazine can be used effectively.

In one embodiment of the invention, first releasable locking means are provided for holding the cover in the release position.

The cover may include at least one guide surface which cooperates with a stationary counter-guide surface in such a way that, upon displacement into the release position, the cover is displaced obliquely relative to the feed direction. In this way it is possible to couple displacement of the cover into its release position with displacement of the slide into its retracted position, which occurs along the feed direction. In this connection, it is furthermore preferred that the cover has, at its rearward end, a stop surface which cooperates with a stop surface on the slide when the latter is brought into its retracted position, against the action of the feed spring, and presses the cover rearwardly. Pulling-back of the slide into the loading position thus automatically leads to displacement of the cover into its release position.

The stop surfaces may be arranged parallel to one another and extending obliquely to the feed direction. If the slide is pulled backwards and the stop surfaces are in engagement with one another, then the latter move relatively against one another, while the cover is displaced into its release position. Second releasable locking means, which simultaneously form the first locking means for the cover, are conveniently provided for holding the slide in its retracted position. As long as the slide is held in its retracted position, the cover is disposed in its release position.

There are various possibilities for effectively guiding the cover. In one embodiment of the invention, the guide surfaces on the cover are formed by an inclined slot, through which there is guided a pin which is stationary relative the magazine and which forms the counter-guide surface. Advantageously, there are provided two such inclined slots and two pins.

The magazine according to the invention is intended for use with fastener elements of any desired design, but it is particularly advantageous for use with U-shaped staples. The guide preferably comprises a vertical guide rail, on which the staples are located; the slide is likewise located on the guide rail and is provided with lateral arms for the staple feed, which arms extend approximately parallel to the sides of the guide rail, and the guide rail has, adjacent the rear thereof, a shoulder which forms a locking stop for the front end of the associated slide arm. When being moved into the retracted position, the front end of the associated slide arm engages behind the shoulder, whereby the slide is held in the retracted position. The slide may comprise, on one side, a handle which is manually operable, and the shoulder is provided on the side of the slide that is remote from the guide rail. Since the slide has a certain clearance in relation to the guide rail, it can, through the operation of the handle, be swung in such a way that the shoulder releases the associated arm, so that the slide can, under the action of the feed spring, bear against the last staple of the strip of staples.

To facilitate location of the slide in its retracted position and disengagement thereof from the shoulder, the guide rail preferably comprises, rearwardly of the shoulder, an inclined surface such that the cross-section of the guide rail tapers from top to bottom, and there is arranged, in the region of the inclined surface, a resilient pressure element which is movable towards the inclined surface so as to press the adjacent arm of the slide against said inclined surface. With the aid of the inclined surface and the pressure element, the slide is somewhat tilted, so that the front of the one slide arm can effectively enter into engagement with the shoulder on the guide rail. Tilting of the slide in the opposite direction towards the pressure element releases the slide from its position of engagement.

The guide desirably comprises a vertical guide rail on which the staples and the slide are located and there is arranged, parallel to the guide rail, a carrying rail which is fastened to the apparatus housing. The carrying rail has an upper plane surface, which serves as a guiding surface for the cover. In a preferred embodiment the carrying rail has a vertical surface which extends approximately parallel to the adjacent surface of the guide rail, the distance between these surfaces being slightly greater than the width of a limb of a staple, and the side of the cover that faces the guide rail is, in its release position, aligned with the surface of the carrying rail. In the release position of the cover, the surface thereof which faces the guide rail forms, with the respective surface of the carrying rail, a continuous sliding surface for the one limb of the staples, the provision of which continuous surface facilitates the insertion of the staples into the magazine.

The carrying rail preferably has a U-shaped profile and one limb is fastened to the outer side of a carrier plate, on which the guide rail is also fastened, the outer surface of the other limb of the U forming the guide surface for the cover, and the outer surface of the base of the U faces the guide rail. In the interior of the U-shaped carrying rail, the feed spring which acts on a pin of the slide is provided, which pin passes through a longitudinal slot in the base of the U-shaped carrying rail. In this manner, there is provided a favourable arrangement of the feed spring which can, for example, be a coil spring.

DESCRIPTION OF THE PREFERRED EMBODIMENT

Figure 1:
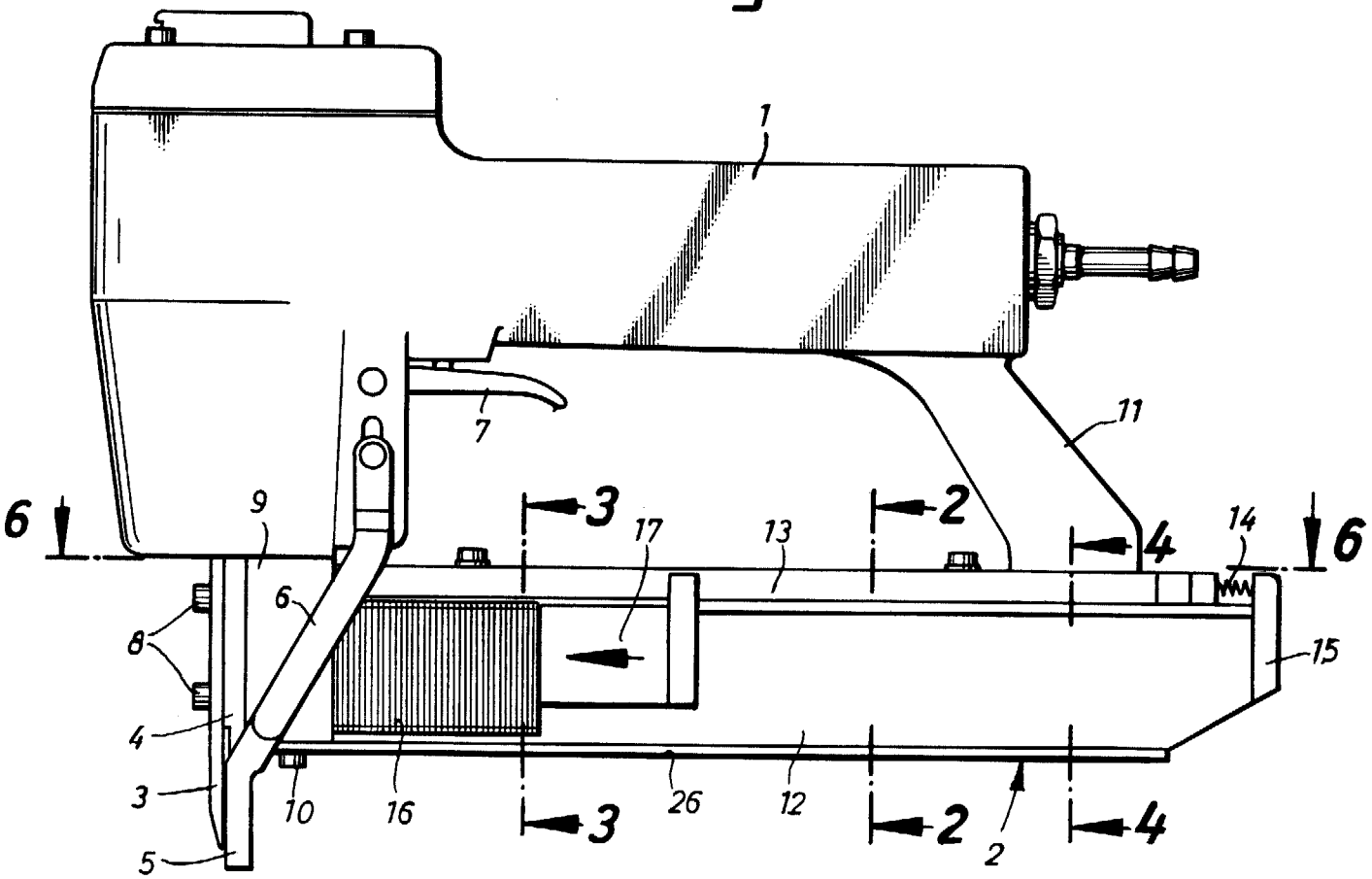
FIG. 1 is a diagrammatical view of a pneumatic device for the driving-in of staples with a magazine according to the invention.
Figure 1A:
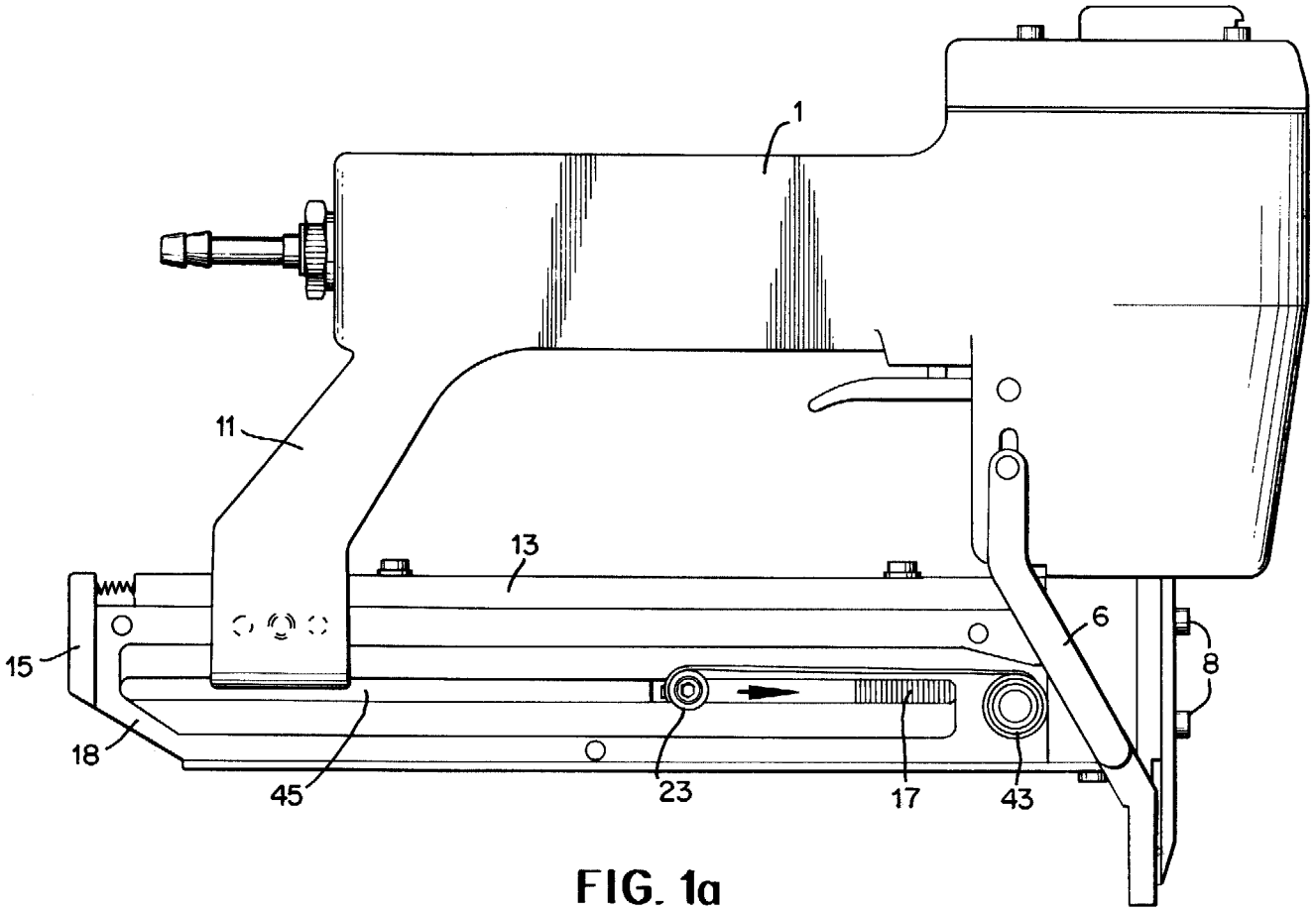
FIG. 1*a* is an elevational view of the opposite side of the staple driving machine.

The pneumatic stapling device shown in FIG. 1 comprises a housing 1, a staple magazine 2, a head, consisting of two tools 3 and 4 which together form a guide channel, and a support 11. The support 11 is connected to the housing 1 at its one end and to the magazine 2 at its other end. A movable trip 5, which cooperates with a valve lever 7 via a stirrup 6, is arranged at the head of the pneumatic nailing device. Only when the trip 5 and the valve lever 7 are operated at the same time is the device in a condition in which a fastener driving operation can be performed.

The tools 3 and 4 are fixedly secured to a head part 9 of the housing 1 by means of screws 8. The head part is, as can be seen from FIGS. 5 and 6, fork-shaped in design. The magazine 2 is fixedly secured in turn to the forks of the head part 9 by means of screws 10. The magazine 2 includes a guide rail 12, on which the staples, which are in the form of a staple strip, are seated. Furthermore seated on the guide rail is a staple pusher slide 17, which is of U-shape in cross-section and which presses, under the action of a feed spring 43, the staples 16 on the guide rail 12 in the direction of the guide channel provided by the tools 3 and 4.

Figure 4:
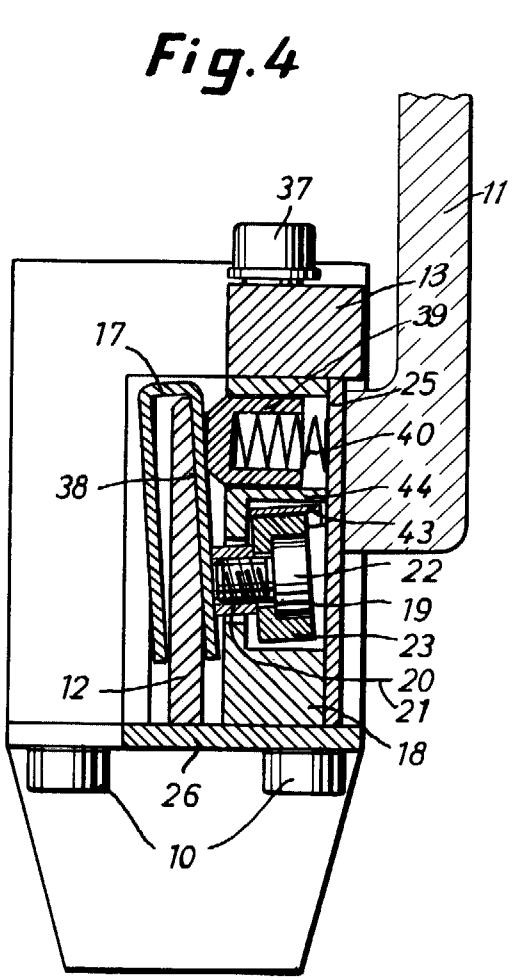
FIG. 4 is a section through the magazine of FIG. 1 along the line 4—4, with the staple slide in the pulled-back position.
Figure 3:
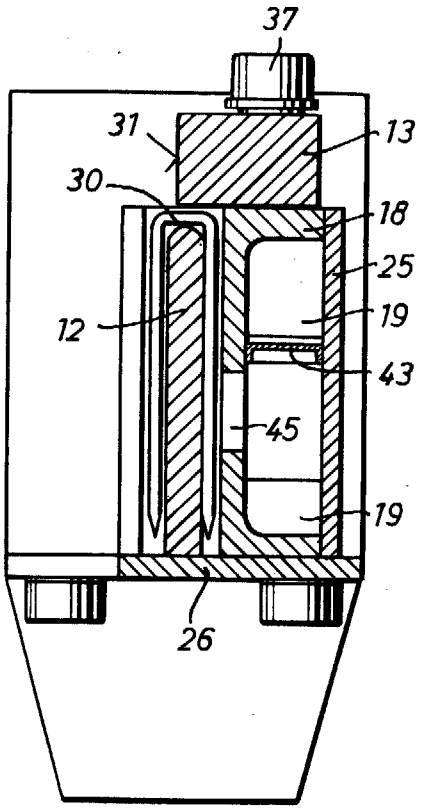
FIG. 3 is a section through the magazine of FIG. 1 along the line 3—3.
Figure 2:
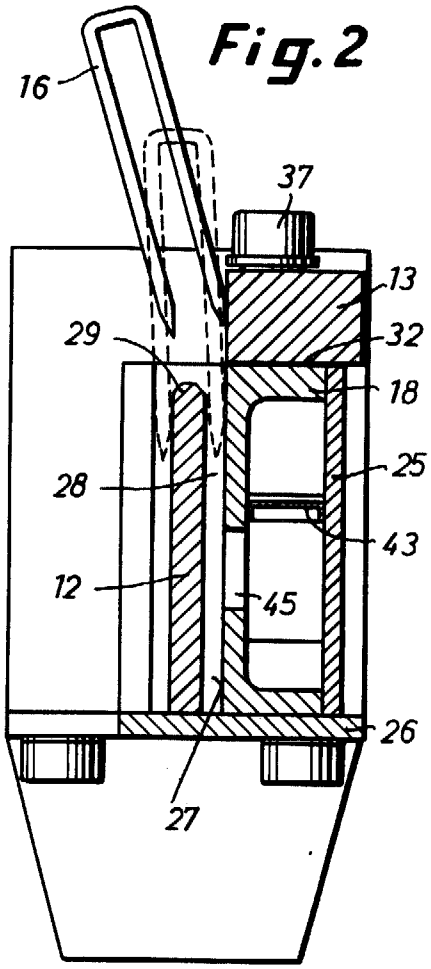
FIG. 2 is a section through the magazine of FIG. 1 along the line 2—2, during the insertion of a staple strip.
Figure 5:
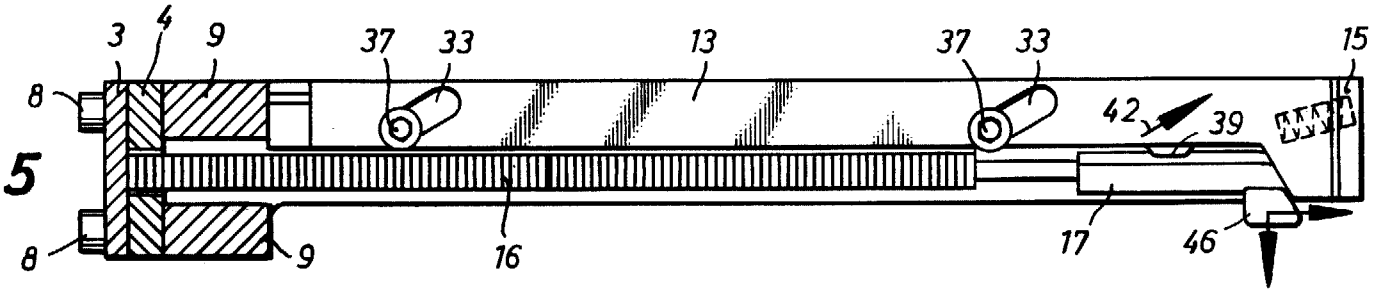
FIG. 5 is a plan view of the magazine of FIG. 1, with the covering rail in the release position.

The guide rail 12 is connected by means of a bracket 26 to a U-shaped carrying rail 18 which is secured to the head part 9. The outer surface of the base of the U-shaped carrying rail 18 extends approximately parallel to the adjacent surface of the guide rail 12. The distance between said surfaces is slightly greater than the width of a limb of a staple. The outer surface of the upper arm of the U-shaped carrying rail 18 forms a sliding surface for a covering rail 13 and the distance between the upper surface of the guide rail 12 and the sliding surface is slightly greater than either the thickness of a staple crosspiece or the thickness of the crosspiece of the staple pusher slide 17. The covering rail 13 is formed with two parallel slots 33, which extend obliquely to the carrying rail and through which headed screws 37 are guided, The screws 37 being fastened to the carrying rail 18. The slots 33 and the headed screws 37 form guide means whereby the covering rail 13 can be displaced obliquely rearwardly in the direction of the arrow 42 from a covering position (FIGS. 3 and 6) into a release position (FIGS. 2, 4 and 5). A pressure spring 14, which is supported on a rear end plate 15 fastened to the magazine, continuously urges the covering rail 13 back in the direction of the arrow 48 into the covering position of FIGS. 3 and 6.

In the release position of the covering rail 13, the surface thereof which faces towards the guide rail 12 provides, together with the outer surface of the base of the U-shaped carrying rail 18, a continuous sliding surface for the lower edges of the limbs of the inserted staples 16, as can be seen from FIG. 2. Therefore, the staple strip 16 can be inserted obliquely and the inclination of the staple strip can be selected in such a way that the operator's hand which is placed around the handle of the instrument does not interfere with insertion of the staples. If the staple strip 16 is subsequently pressed into an approximately vertical position, it will drop, under its own weight, on to the guide rail 12. In the covering position (FIG. 3), the covering rail 13 conceals approximately half the width of the base 30 of each U-shaped staple. However, the spacing between the upper surface 29 of the guide rail 12 and the undersurface of the covering rail 13 is slightly greater than the thickness of the base 30 of a staple.

Figure 7:
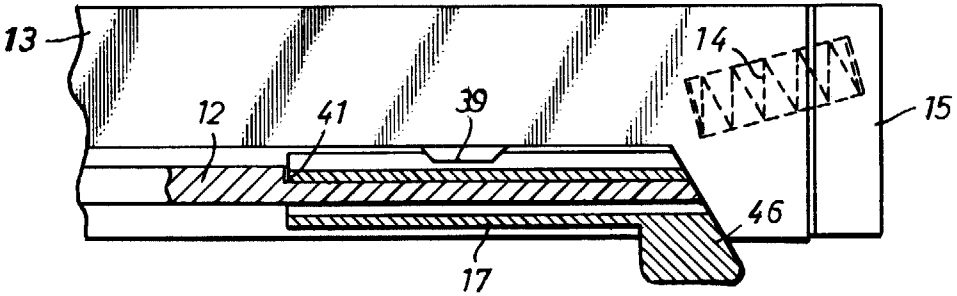
FIG. 7 is a detail sectional view of part of the magazine with the covering rail in the release position.

As can be seen from FIG. 4, the staple pusher slide 17 carries, on the side thereof which faces towards the carrying rail 18, a hollow pin 20 having an internally threaded bore 21. A cup-like part 23 is permanently connected to the pin 20 by means of a screw 22. Connected to the cup-like part 23 there is one end of the feed spring 43, which presses the staple pusher slide 17 in the direction of the guide channel between the tools 3 and 4. As can be seen from FIG. 4, the lower surface of a limb 44 of the carrying rail 18 forms a guide track for the cup-like part 23 and the hollow pin 20 is guided by passage through a longitudinal slot 45 in the carrying rail 18. As can best be seen from FIG. 4, the guide rail 12 has, at its rearward end, an inclined surface 38 such that the rail 12 tapers upwardly in transverse cross-section. The inclined surface 38 is formed behind a shoulder 41 on the rail 12, as can be seen from FIG. 7. As can also be seen from FIG. 4, a pressure element 39 is displaceably mounted in the carrying rail 18 and is movable approximately at right angles to the feed direction. The pressure element 39 is hollow and contains a spring 40 the other end of which bears against a plate 25 which closes the interior 19 of the carrying rail 18. The spring 40 urges the pressure element 39, which has a tapered front end, against one side of the staple pusher slide 17, when the latter is pulled backwards by means of the handle 46. The pressure element 39 biases the inner surface of the adjacent limb of the staple pusher slide 17 against the inclined surface 38, so that the staple pusher slide 17 is tilted to some extent and can thus locate, in the fully retracted position, behind the shoulder 41, whereby the slide is locked in its retracted position.

Figure 6:
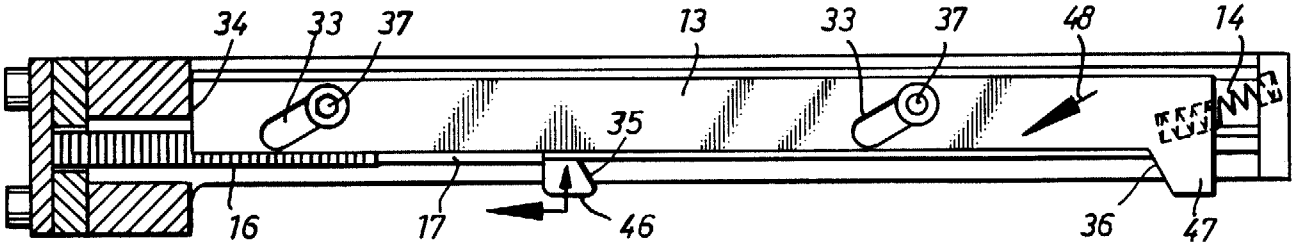
FIG. 6 is a plan view of the magazine of FIG. 1, with the covering rail in the covering position.

As can best be seen from FIGS. 5 and 6, the handle 46 of the staple pusher slide 17 is provided with a rearward inclined cam surface 35, which extends approximately parallel to a cam surface 36 of a lateral projection 47 at the rearward end of the covering rail 13. If the staple pusher slide 17 on the handle 46 is retracted, the cam surface 35 strikes against the cam surface 36 and thus also moves the covering rail 13 rearwardly, whereby the rail 13 is pressed in the direction of the arrow 42 into its release position. As soon as the front end of the one limb of the staple pusher slide 17 is located behind the shoulder 41, the slide 17 simultaneously locks the covering rail 13 in its release position. By displacing the handle 46 against the action of the pressure element 39, the staple pusher slide 17 can be brought out of engagement with the shoulder 41, so that it is moved, under the action of the roll feed spring 43, so as to engage and bear against the inserted strip of staples. The configuration and particular arrangement of the feed spring 43 are not described in detail, since this is well-known and without significance so far as the construction and the mode of operation of the magazine is concerned.

What is claimed is:

1. A magazine for apparatus for driving fastener elements comprising, in combination, a lower bracket adapted to be fastened to fastener driving apparatus, said bracket having a fastener ejection channel end and a rear end, and elongated guide mounted upon said bracket extending thereabove and including a free upper edge over which an elongated strip of fastener elements may be supportably placed and longitudinally displaced toward said bracket ejection channel end, a cover support member mounted upon said bracket and extending thereabove disposed adjacent and parallel to said guide and having a cover guiding upper surface, a fastener cover slidably displaceably mounted upon said cover upper surface for lateral movement with respect to said guide between a release position wherein said cover fully exposes the upper free edge of said guide to permit a strip of fasteners to be placed upon said guide by a relative lateral movement between said guide and the strip of fasteners and an operative position wherein said cover is superimposed over said guide in spaced relation to said guide upper edge confining the fastener elements upon said guide, and a resiliently biased fastener element pusher slide slidably mounted adjacent said guide engaging fastener elements supported thereon and biasing the elements toward said bracket ejection channel end.

2. In a magazine as in claim 1, an oblique slot in said cover through which a pin defined on said cover support member extends, said slot being oblique to said guide and displacement of said cover from said operative to said release positions moves said cover in an oblique direction opposite to the direction in which the fastener elements are biased by said fastener element pusher slide.

3. In a magazine as in claim 1, a first cam surface defined on said cover adjacent said bracket rear end, a second cam surface defined on said slide engagable with said first cam surface when said slide is moved against its biasing force into a slide rearward position adjacent said bracket rear end, said cam surfaces interacting to displace said cover from said operative to said release positions.

4. In a magazine as in claim 3 wherein said cam surfaces are parallel to one another and oblique to said guide and direction of slide movement.

5. In a magazine as in claim 1 wherein said guide comprises a vertical rail having sides and on which the fastener elements are supported, said pusher slide being supported on said rail and including lateral arms substantially parallel to the sides of said rail, and a shoulder defined on said rail adjacent said bracket rear end forming a locking stop for selective engagement with an arm of said slide.

6. In a magazine as in claim 5, a manually operable handle on said slide, said shoulder being on the side of said rail remote from said handle whereby said slide may be released by said handle from said shoulder.

7. In a magazine as in claim 5 wherein said rail is formed rearwardly of said shoulder with an inclined surface on the rail side in which said shoulder is defined such that the cross section of said rail tapers from said bracket toward said free edge, and a resilient pressure element supported on said cover support member movable toward said inclined surface biasing said slide against said inclined surface when said slide is adjacent said bracket rear end.

8. In a magazine as in claim 1 wherein said guide comprises a vertical guide rail on which the fastener element and said slide are supported, said cover support member comprising a carrying rail extending parallel to said guide rail, said carrying rail having an upper surface upon which said cover is slidably mounted.

9. In a magazine as in claim 8 wherein said carrying rail includes a vertical surface which extends approximately parallel to the adjacent surface of said guide rail, the distance between said surfaces being slightly greater than the width of a portion of a fastener element disposed adjacent said guide rail surface, said cover, in its release position, being aligned with said surface of said carrying rail.

10. In a magazine as in claim 8 wherein said carrying rail has a U-shaped cross section and one arm thereof is fastened to said bracket, the other arm of said carrying rail forming a guide surface for said cover, the outer surface of the base of said carrying rail facing said guide rail and a spring for biasing said slide located intermediate said arms.

* * * * *